US006023897A

United States Patent [19]

Leslie et al.

[11] Patent Number: 6,023,897

[45] Date of Patent: Feb. 15, 2000

[54] ADJUSTABLE FOUNDATION WALL ARRANGEMENT

[75] Inventors: Robert H. Leslie, Edina; Robert J. Leslie, Richfield, both of Minn.

[73] Assignee: International Building Concepts, Ltd., Anoka, Minn.

[21] Appl. No.: 09/152,424

[22] Filed: Sep. 13, 1998

[51] Int. Cl.[7] ..... E02D 27/00; E04B 2/70

[52] U.S. Cl. ..... 52/292; 52/293.1; 52/481.1; 52/483.1; 52/581; 52/582.1; 52/645; 52/690; 52/745.1

[58] Field of Search ..... 52/292, 293.1, 52/481.1, 483.1, 581, 582.1, 645, 690, 745.1

[56] References Cited

U.S. PATENT DOCUMENTS 3,813,832 6/1974 Caplan ..... 52/581 X
4,349,995 9/1982 Dowler et al. ..... 52/581 X
5,685,115 11/1997 Colfer ..... 52/292

*Primary Examiner*—Christopher T. Kent

[57] ABSTRACT

An adjustable foundation wall arrangement having first and second foundation walls running generally parallel to each other and a third foundation wall being disposed between the first and second foundation walls. The first and second foundation walls are preferably prefabricated and the third foundation wall is prefabricated in two portions. On site, one of the third foundation wall portions is aligned to the first foundation wall and the other of the third foundation wall portions is aligned to the second foundation wall. This alignment typically leaves a small space between the inner ends of the third foundation wall portions. This small space, preformed in the shape of a receptor for a key stud, is at least partially filled by the key stud to tie the third foundation wall portions to each other. Alternatively, or preferably in combination with the key stud, a cap tie connects the third foundation wall portions to each other. The cap tie includes two ends, and each end abuts a cap plate, one of which in turn connects to the first foundation wall and the other of which connects to the second foundation wall.

15 Claims, 9 Drawing Sheets

ADJUSTABLE FOUNDATION WALL ARRANGEMENT

BACKGROUND OF THE INVENTION

The present invention relates generally to foundation walls for residential homes, more particularly to such foundation walls that are at least partially prefabricated, and specifically to such foundation walls that are adjustable in the field.

The ideal prefabricated home is one that is entirely prefabricated at the factory. Of course, transport of the house as a whole to the field would be impractical. Instead, the "prefabricated home" is one that has "prefabricated parts." Those parts, then, are assembled in the field.

One problem with assembly of the prefabricated parts in the field is that the parts may not necessarily fit together in the desired precise manner. The reasons for this are numerous. For example, it may be cost prohibitive to make the dimensions of the prefabricated parts perfect in the factory. Or, even if the prefabricated parts have perfect or near perfect dimensions, the foundation dug or built for the house may be imperfect.

SUMMARY OF THE INVENTION

A feature of the present invention is a foundation wall arrangement that is adjustable in the field so that the foundation wall arrangement may line up perfectly or nearly perfectly with the walls of the house.

Another feature of the present invention is such a foundation wall arrangement that includes a first foundation wall that is prefabricated, a second foundation wall that is prefabricated, and a third foundation wall that includes a pair of foundation wall portions that are prefabricated, wherein one of the third foundation wall portions is aligned with the first foundation wall and the other of the third foundation wall portions is aligned with the second foundation wall, and wherein subsequently the third foundation wall portions are tied to each other and tied to the first and second foundation walls.

Another feature of the present invention is a first tie for tying in the third foundation wall portions to each other. This first tie is a key stud engaging a receptor formed by the inner ends of the third foundation wall portions.

Another feature of the present invention is a second tie for tying in the third foundation wall portions to each other. This second tie is a cap tie aligned with the third foundation wall portions and abutting or nearly abutting other cap ties that in turn tie into the first and second foundation walls.

Another feature of the present invention is a method of forming the foundation wall arrangement wherein such method includes the steps of prefabricating each of the first and second foundation walls as a whole, prefabricating each of the third foundation wall portions as a whole, then in the field aligning each of the third foundations walls to one of the first and second foundation walls, then tying the third foundation wall portions to each other with the key stud and cap tie and tying the third foundation wall portions to the first and second foundation walls.

An advantage of the present invention is that the finished prefabricated house is more true and strong. The chances are maximized that the foundation walls will be aligned with the walls of the house. Such an alignment gives the house as a whole greater integrity.

Another advantage of the present invention is that the cost of labor and materials is minimized. For example, the dimensions of the prefabricated wall arrangement as made in the factory, while still critical, are less critical. Such less than perfect prefabricated foundation walls need not be disassembled and rebuilt at the factory or in the field. Instead, less than perfect prefabricated foundation walls may be used to build a perfect or near perfect foundation wall arrangement in the field. The cost of labor is thereby reduced. Further, material cost is reduced because less than perfect studs may be used.

BRIEF DESCRIPTION OF THE DRAWINGS

The illustrative embodiments may be best described by reference to the accompanying drawings where.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood.

DESCRIPTION

Figure 1:
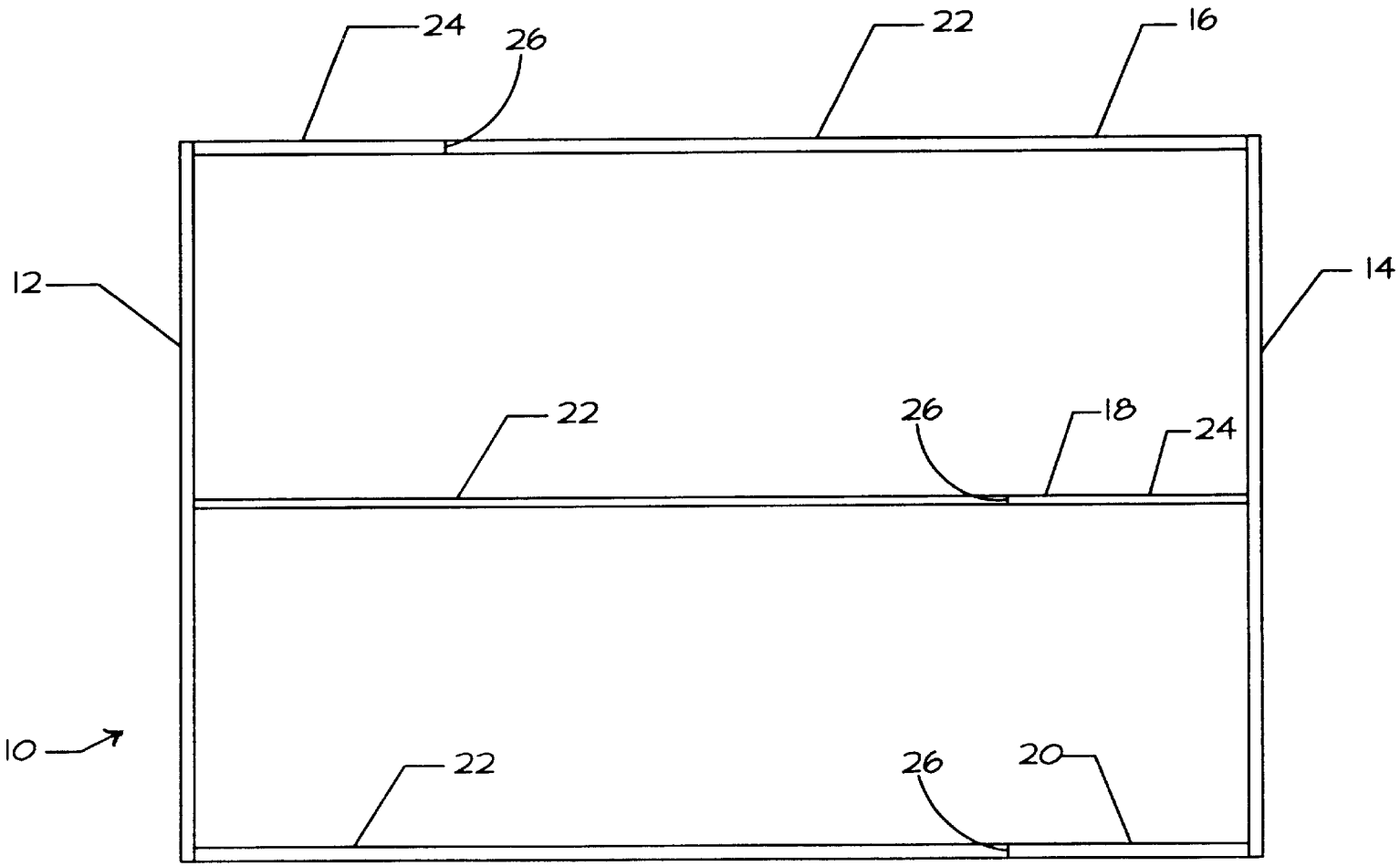
FIG. 1 is a top plan view of the foundation wall arrangement of the present invention and shows at least a first foundation wall, a second foundation wall, and a third foundation wall.

FIG. 1 shows a foundation wall arrangement 10. Foundation wall arrangement 10 includes a first foundation wall 12 and a second foundation wall 14. First and second foundation walls 12, 14 run parallel to each other and are the shorter, end foundation walls.

FIG. 1 further shows a set of three "third" foundation walls 16, 18, and 20. Foundation walls 16 and 20 are side, exterior foundation walls. Foundation wall 18 is an interior foundation wall. Foundation walls 16, 18, and 20 are set inside of the end foundation walls 12, 14.

FIG. 1 further shows that each of the third foundation walls 16, 18 and 20 include two foundation wall portions 22 and 24. Reference number 26 denotes a joint or seam between the two foundation wall portions 22 and 24. Wall portions 22 and 24 are preferably engaged in line with each other.

Walls 12 and 14 are preferably engaged at right angles to walls 16, 18 and 20. Each of the walls 12, 14, 16, 18 and 20 includes an upper strip of dimensional lumber (preferably a strip measuring two inches by six inches), a lower strip of dimensional lumber (preferably a strip measuring two inches by six inches), and a plurality of studs running between the upper and lower strips (where each of the studs is preferably a stud of dimensional lumber measuring two inches by six inches).

Figure 2:
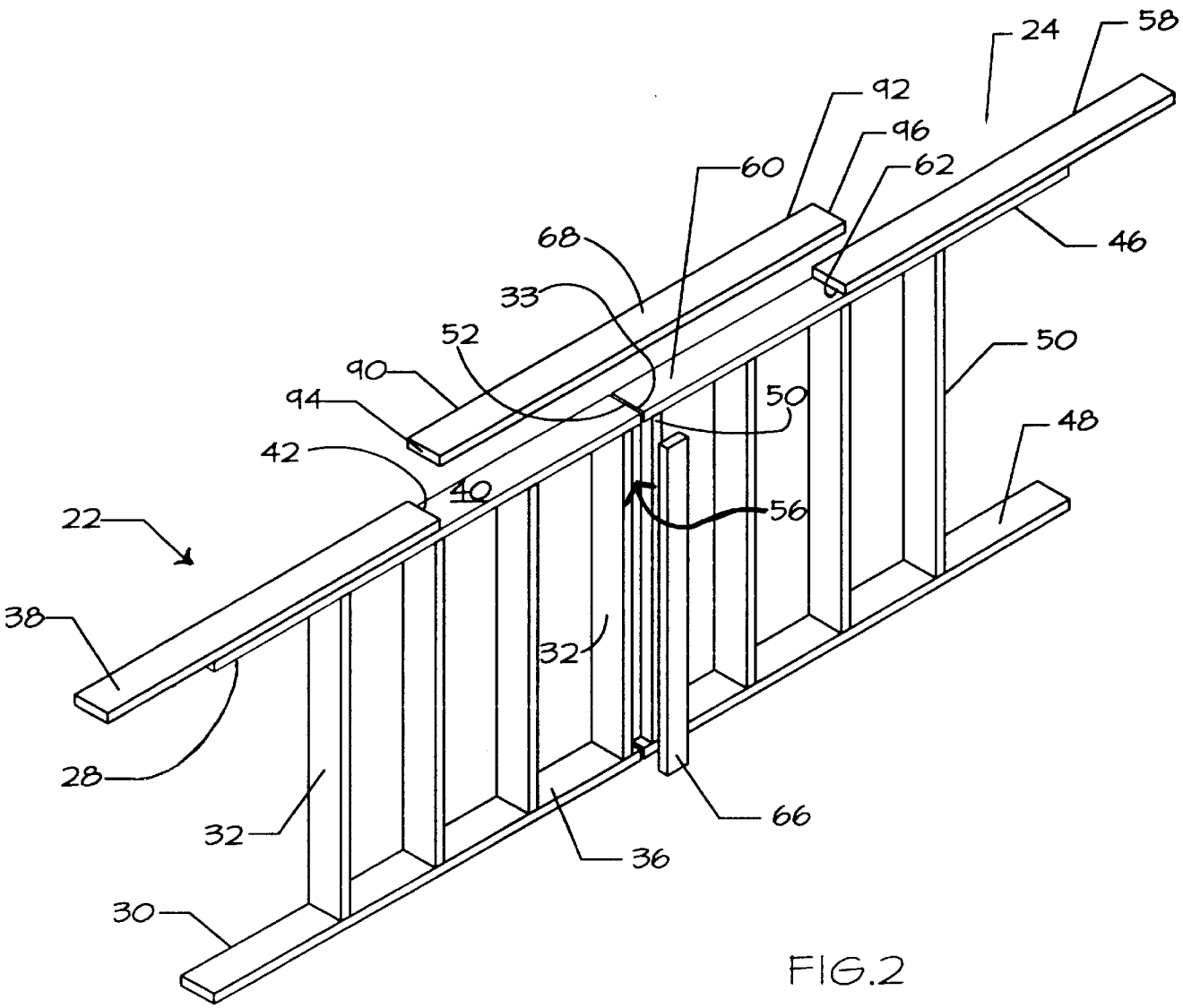
FIG. 2 is a perspective partial front view of two third foundation wall portions of the third foundation wall of FIG. 1.
Figure 3:
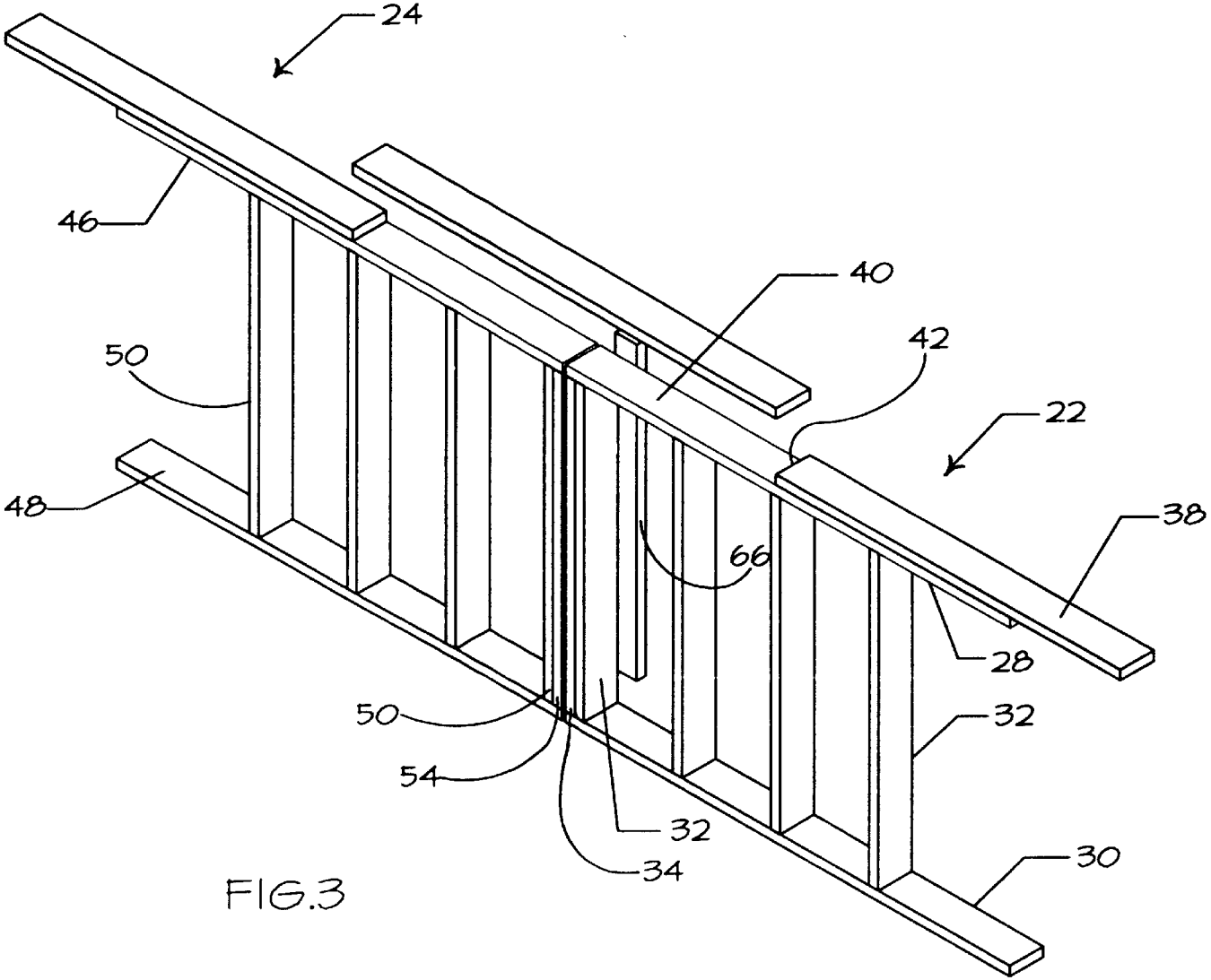
FIG. 3 is a perspective partial rear view of two third foundation wall portions of the third foundation wall of FIG. 2.

FIGS. 2 and 3 show the third foundation wall portions 22 and 24 about to be tied into each other. Third foundation wall portion 22 includes an upper horizontal wood strip 28, a lower horizontal wood strip 30, and a plurality of upright wood studs 32 connecting the upper and lower strips 28 and 30. The upright studs 32 may be fixed to the upper and lower strips 28 and 30 via pin connectors or adhesive or both.

Third foundation wall portion 22 includes an inner end 33 having an upright stud 34. Upright stud 34 includes a width less than its adjacent stud 32 so as to form a receptor portion 36.

Third foundation wall portion 22 further includes a cap or cap strip or cap plate 38. Cap plate 38 is fixed, via pin connectors or adhesive or both, to upper strip 28 and more specifically to an upper face 40 of upper strip 28. Cap plate 38 includes an inner end 42 and an outer end or end extension 44 (shown in FIG. 5A). Inner cap end 42 terminates short of the inner end 33 so as to leave exposed a portion of the face 40 of upper strip 28.

Third foundation wall portion 24, except for overall length, is identical to third foundation wall portion 22. Third foundation wall portion 24 includes an upper horizontal wood strip 46, a lower horizontal wood strip 48, and a plurality of upright wood studs 50 connecting the upper and lower strips 46 and 48. The upright studs 50 may be fixed to the upper and lower strips 46 and 48 via pin connectors or adhesive or both.

Third foundation wall portion 24 includes an inner end 52 having an upright stud 54. Upright stud 54 includes a width less than its adjacent stud 50. so as to form a receptor portion 56.

Third foundation wall portion 24 further includes a cap or cap strip or cap plate 58. Cap plate 58 is fixed, via pin connectors or adhesive or both, to upper strip 46 and more specifically to an upper face 60 of upper strip 46. Cap plate 58 includes an inner end 62 and an outer end or end extension 64 (shown in FIG. 5A). Inner cap end 62 terminates short of the inner end 52 so as to leave exposed a portion of the face 60 of upper strip 46.

Receptor portions 36 and 56 jointly form a receptor for a key tie or key stud 66. Faces 40 and 50 of upper strips 28 and 46 and the inner cap ends 42 and 62 of caps 38 and 58 form a receptor for a cap tie or cap stud 68.

One side or portion of key stud 66 may be tied into one or more of stud 34 and upper and lower strips 28 and 30 via pin connectors or adhesive or both. Such side or portion of key stud 66 may further be tied into stud 32 (adjacent stud 34) via pin connectors or adhesive or both.

The other side or portion of key stud 66 may be tied into one or more of stud 54 and upper and lower strips 46 and 48 via pin connectors or adhesive or both. Such side or portion of key stud 66 may further be tied into stud 50 (adjacent stud 54) via pin connectors or adhesive or both.

Figure 4A:
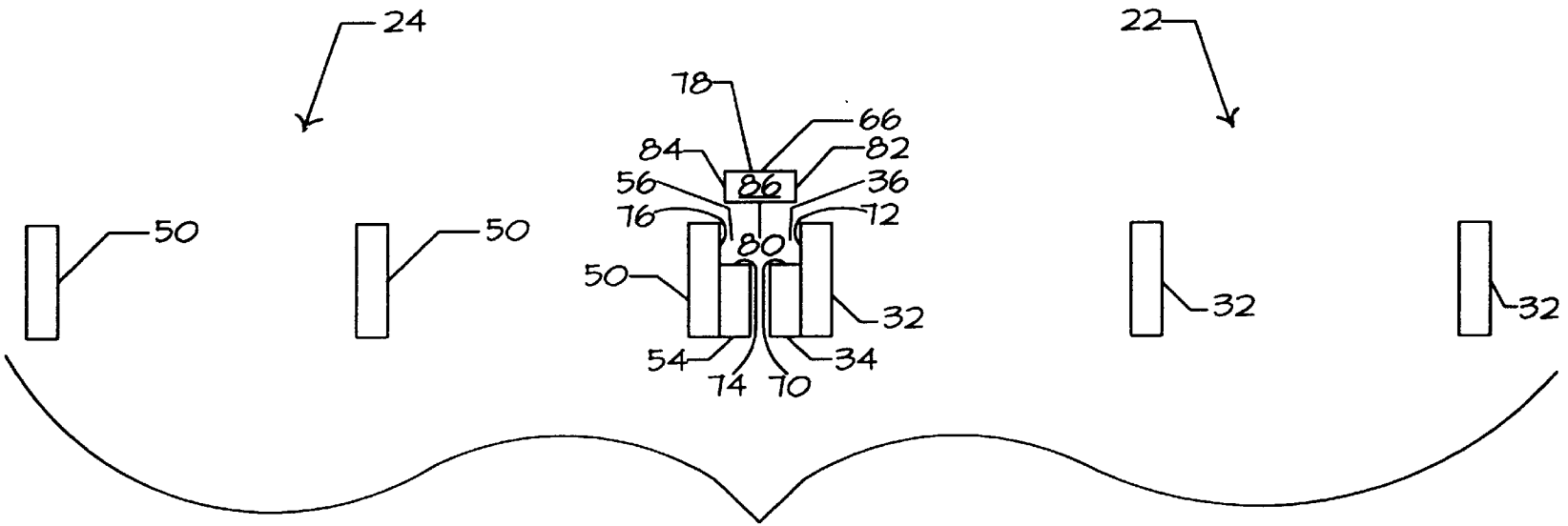
FIG. 4A is a top section view of the two third foundation wall portions of FIG. 2 showing the key stud about to be engaged between the two foundation wall portions.
Figure 4B:
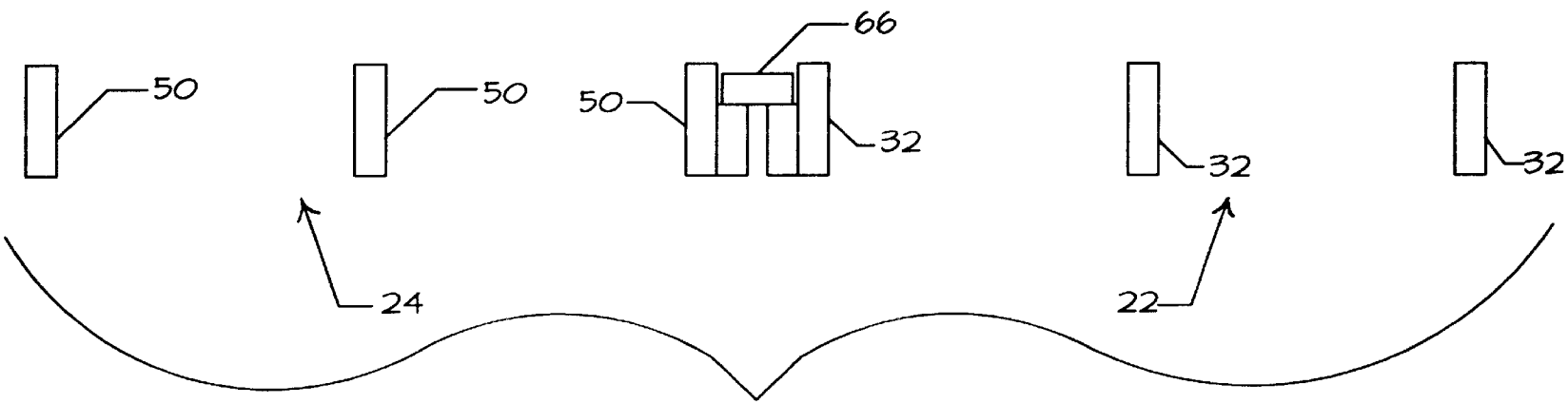
FIG. 4B is a top section view of the two third foundation wall portions of FIG. 2 showing the key stud engaged between the two foundation wall portions.

FIGS. 4A and 4B shows that receptor portion 36 is formed in part by a face 70 of stud 34 and an exposed side face portion 72 of innermost stud 32. Receptor portion 36 is further formed by a portion of the lower face of upper strip 28 and a portion of the upper face of lower strip 30. Likewise, receptor portion 56 is formed in part by a face 74 of stud 54 and an exposed side face portion 76 of innermost stud 50. Receptor portion 56 is further formed by a portion of the lower face of upper strip 46 and a portion of the upper face of lower strip 48.

Key stud 66 includes a front face 78, a rear face 80, and a pair of side faces 82 and 84. Key stud 66 further includes an upper end 86 and a lower end 88 (shown in FIG. 5B). When engaged, key stud 66 preferably engages one face on each of the wall portions 22 and 24, more preferably engages two faces on each of the wall portions 22 and 24, even more preferably engages three faces on each of the wall portions 22 and 24, and most preferably engages four faces on each of the wall portions 22 and 24.

In its most preferred orientation, key stud 66 engages 1) face 70 with key stud face 80, 2) face or face portion 72 with key stud face 82, 3) the lower face of upper strip 28 with key stud end 86, 4) the upper face of lower strip 30 with key stud end 88, 5) face 74 with key stud face 80, 6) face or face portion 76 with key stud face 84, 7) the lower face of upper strip 46 with key stud end 86 and 8) the upper face of lower strip 48 with key stud end 88. Most likely, key stud 66 engages all of the above noted faces or face portions except the inner faces of innermost studs 32 and 50 (i.e. face or face portions 72 and 76) because walls 22 and 24 are drawn apart to be aligned with walls 12 and 14 and such a drawing apart may slightly space the innermost studs 32 and 50 from key stud 66.

Figure 5A:
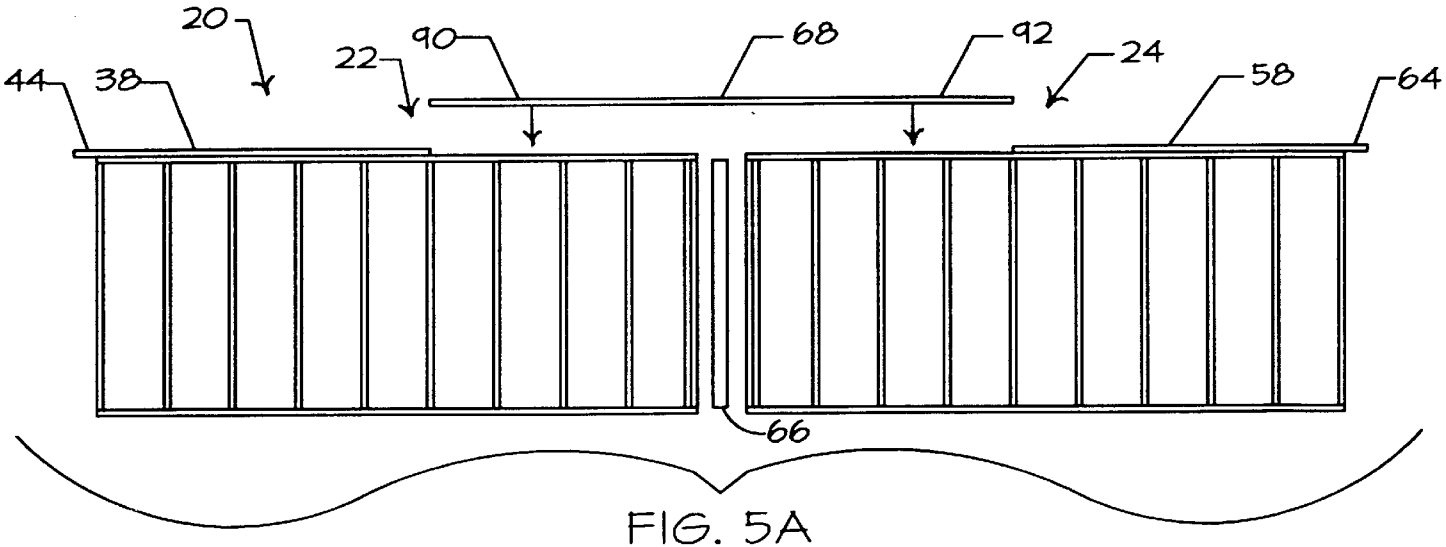
FIG. 5A is a side elevation view of both of the third foundation wall portions about to be tied into each other to make up an exterior foundation wall.
Figure 5B:
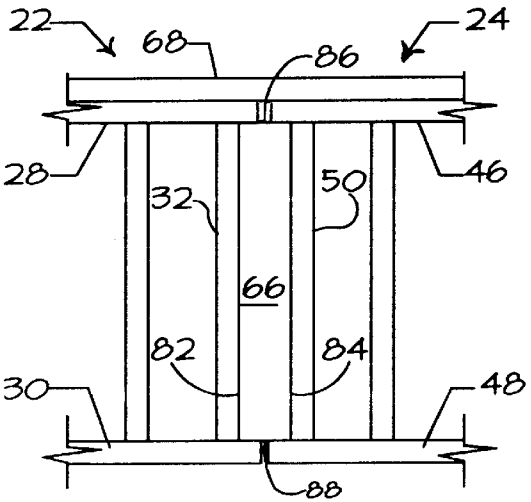
FIG. 5B is a detail side elevation view of the third foundation wall portions tied into each other.

As shown in FIGS. 2, 3 and 5A, cap tie 68 includes a pair of ends 90, 92. End 90 includes face 94. End 92 includes face 96. When engaged to wall portions 22 and 24, face 92 preferably abuts end 42 of cap 38 and face 94 preferably abuts end 62 of cap 58. Most likely, face 92 is spaced from end 42 and face 94 is spaced from end 62 because, in the final aligned position of walls 22 and 24, walls 22 and 24 are relatively drawn apart so as be aligned with walls 12 and 14.

FIG. 5A shows that wall portion 22 is relatively long and that wall portion 24 is relatively short. Such is preferred so that a relatively long foundation wall may be formed using two wall portions 22, or so that a relatively short foundation wall may be formed using two wall portions 24.

Figure 6B:
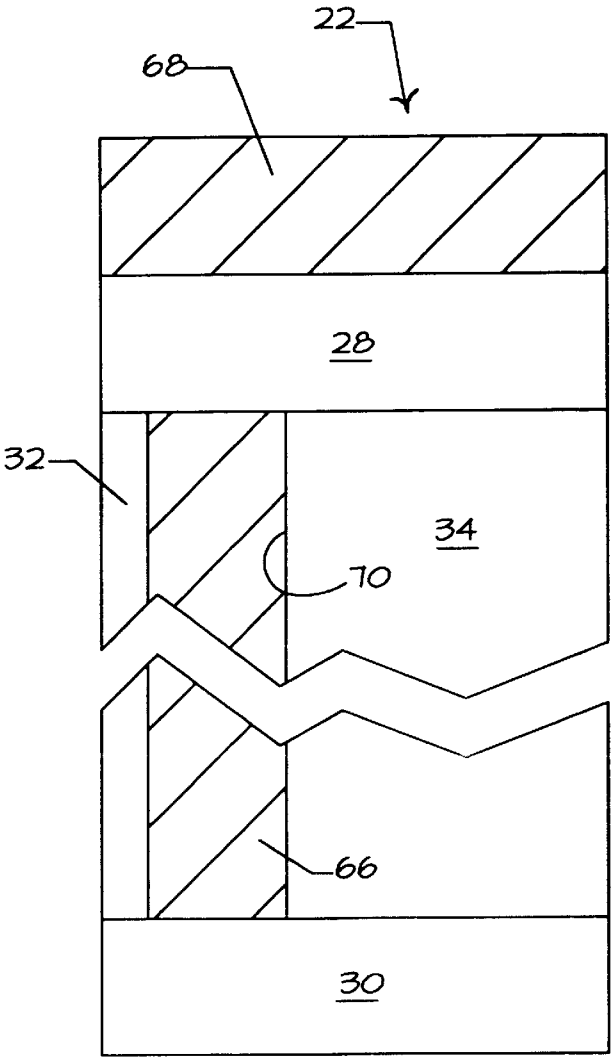
FIG. 6B is a section view of the third foundation wall after the third foundation wall portions have been tied into each other.
Figure 6A:
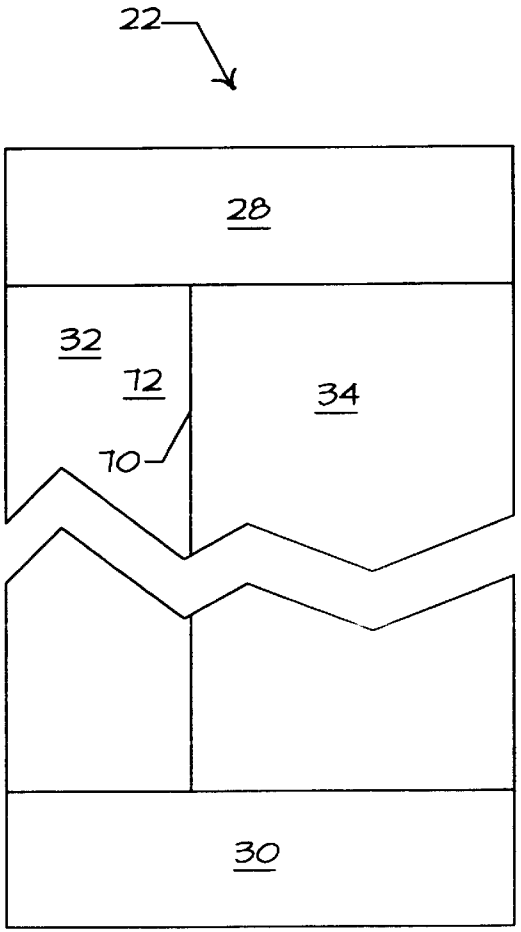
FIG. 6A is an end elevation view of an inner end of one of the third foundation wall portions prior to tying the third foundation wall portions into each other.

FIGS. 6A and 6B show inner end 33 of foundation wall portion 22 with and without engagement of key stud 66 and cap tie 68. FIG. 6B shows abutment of the key stud 66 with the three most likely faces of wall foundation portion 22, i.e. with face 70 of stud 34, lower face of upper strip 28 and upper face of lower strip 30.

Figure 7A:
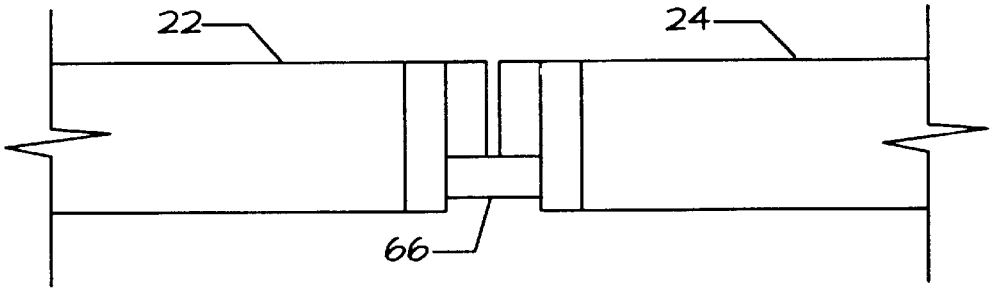
FIG. 7A is a top view showing how the key stud precisely engages the receptor in the third foundation wall where the third foundation wall portions have been precisely prefabricated and the foundation has been perfectly dug out.
Figure 7B:
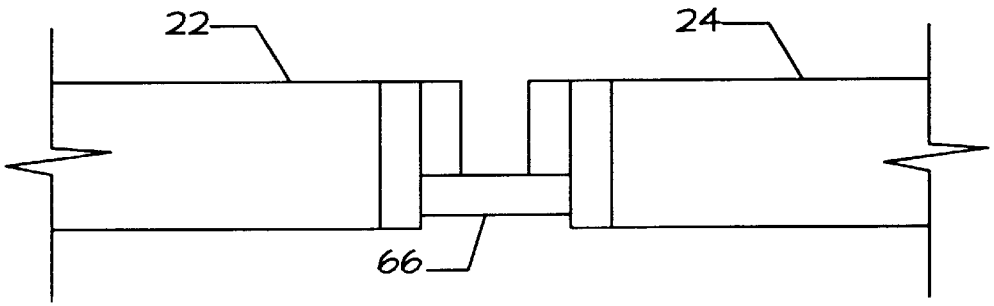
FIG. 7B is a top view showing how the key stud may abut two faces of each of the third foundation wall portions.
Figure 7C:
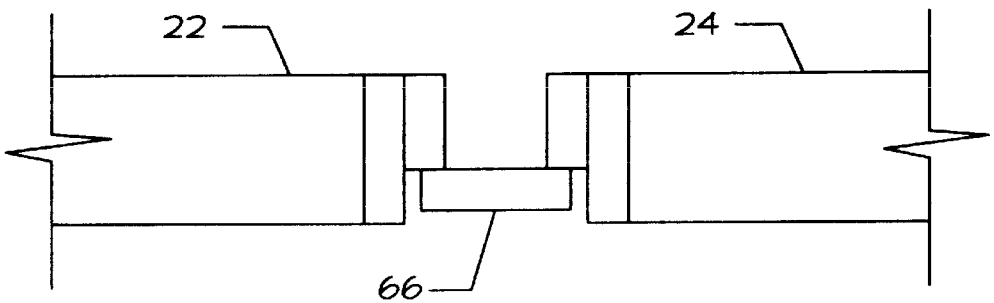
FIG. 7C is a top view showing how the key stud may abut one face of each of the third foundation wall portions.

FIG. 7A shows an embodiment where a relatively narrow key stud 66 abuts all eight faces of foundation wall portions 22 and 24. FIG. 7B shows an embodiment where a relatively wide key stud 66 abuts all eight faces of foundation wall portions 22 and 24 with all eight faces of foundation wall portions 22 and 24. FIG. 7C shows an embodiment where key stud 66 abuts six faces of foundation wall portions 22 and 24.

Figure 8A:
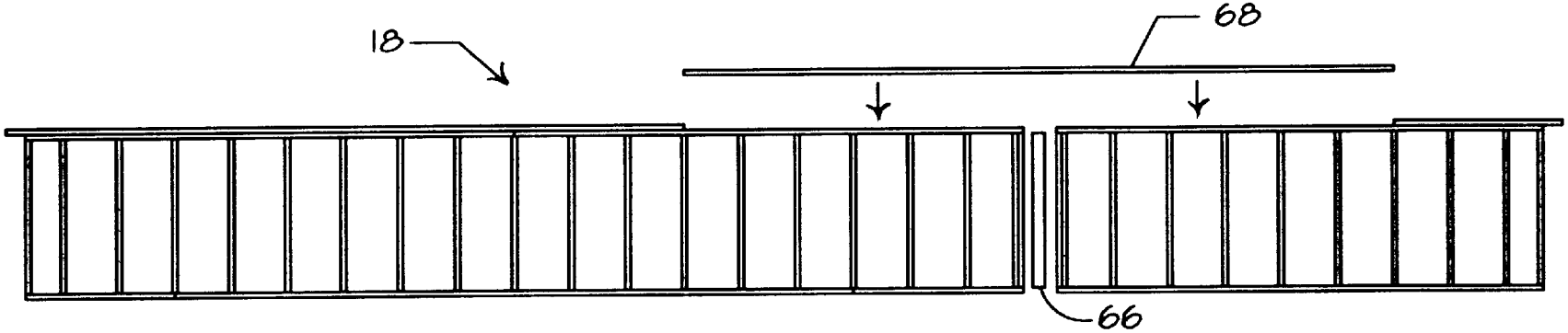
FIG. 8A is a side elevation view of both of the third foundation wall portions about to be tied into each other to make up an interior foundation wall.

FIG. 8A shows that interior foundation wall 18 is identical to exterior foundation walls 16 and 20 (shown in FIG. 5A).

Figure 8B:
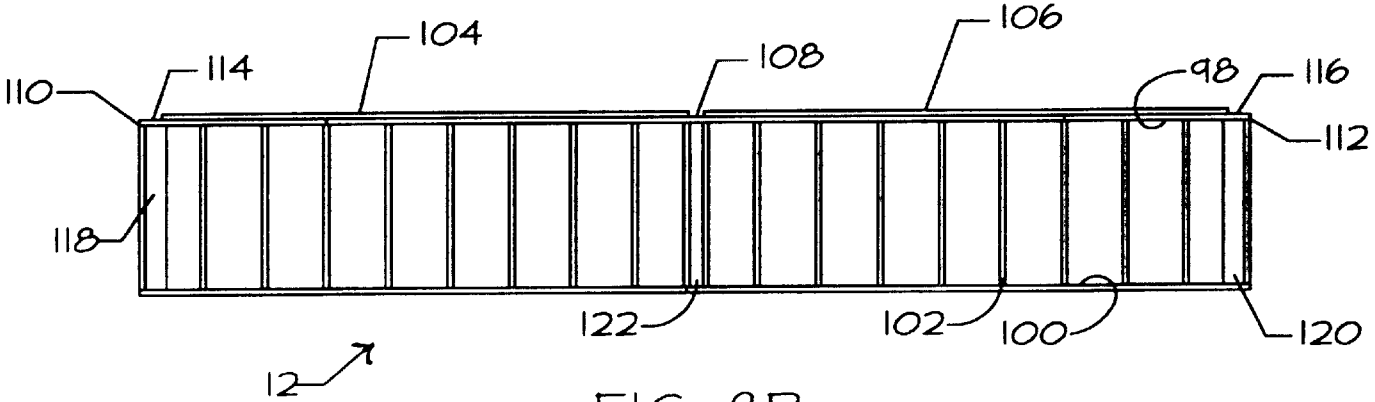
FIG. 8B is a side elevation view of the first (or second) foundation wall.

FIG. 8B shows end foundation 12 (or 14). End foundation wall 12 includes an upper horizontal elongate strip 98, a lower horizontal elongate strip 100, and a plurality of connecting studs 102. Studs 102 are fixed to the upper and lower strips 98 and 100 via pin connectors or adhesive or both.

End foundation wall 12 further includes a pair of cap plates 104 and 106 spaced from each other so as to form a receptor 108 for one of the cap tie ends or end extensions 44 or 64 of foundation wall portions 22 and 24 of interior foundation wall 18. Cap plates 104 and 106 are further spaced from ends 110 and 112 of upper strip 98 so as to form receptors 114 and 116 for one of the cap tie ends or end extensions 44 or 64 of foundation wall portions 22 and 24 of one of the exterior walls 16 and 20.

End foundation walls 12 further include upright studs 118, 120 and 122 turned 90 degrees relative to upright studs 102. This orientation offers a face of a greater surface area to foundation walls 16, 18 and 20 for tying in the foundation walls 12 and 14 with walls 16, 18 and 20 via pin connectors or adhesive or both.

Outer studs 118 and 120 are fixed to outermost studs 102. Inner stud 122 is fixed to an between two inner studs 102 and directly beneath receptor 108.

Figure 9A:
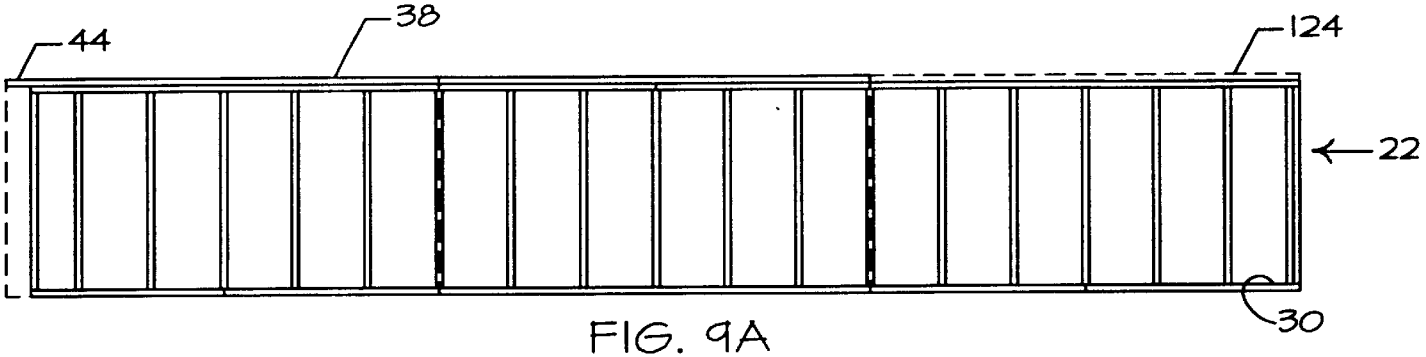
FIG. 9A is a side, partially phantom, view of the one third foundation wall portion covered with sheathing.
Figure 9B:
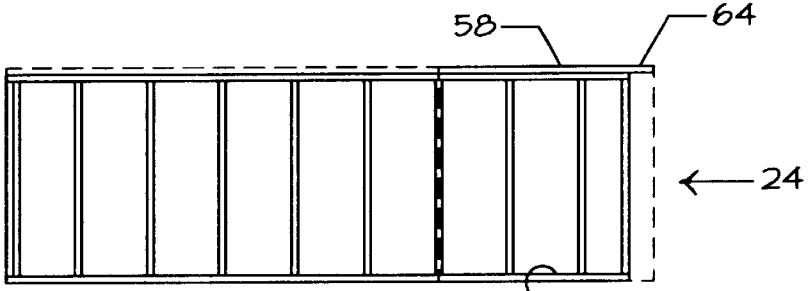
FIG. 9B is a side, partially phantom, view of the other third foundation wall portion covered with sheathing.
Figure 9C:
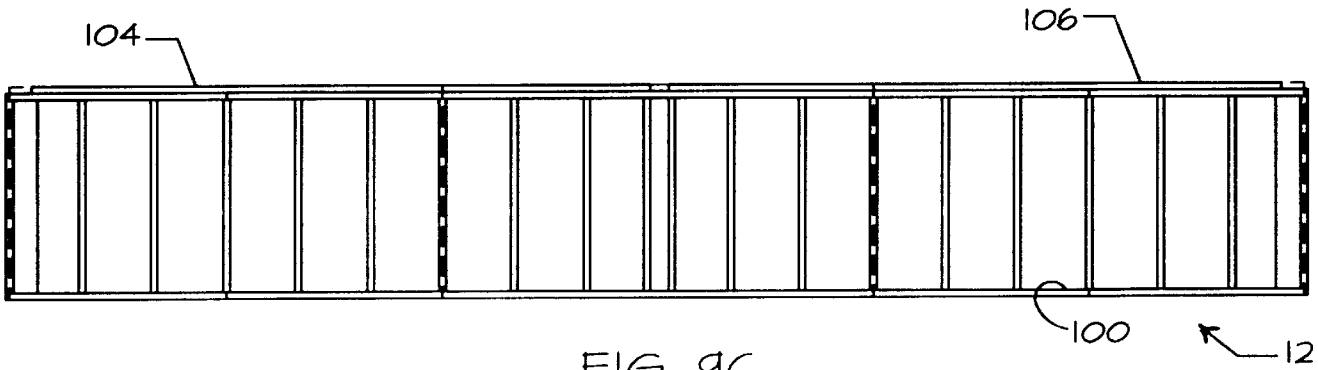
FIG. 9C is a side, partially phantom, view of the first (or second) foundation wall covered with sheathing.

FIGS. 9A, 9B and 9C show that sheathing 124 is engaged to foundation wall portions 22 and 24 in the factory prior to shipping and to foundation wall 12 (and 14) in the factory prior to shipping. Such sheathing 124 preferably covers the exterior face of wall portions 22 and 24 and of foundation wall 12 (and 14). Such sheathing 124 is preferably sheets of four foot by eight foot plywood. The sheathing 124 provides additional support for the foundation walls 12, 14, 16 and 20 and is affixed thereto via pin connectors or adhesive or both. Sheathing 124 preferably extends to cap ends or end extensions 44 and 64, is preferably slightly spaced inwardly from the ends of foundation wall 12 (and 14), is flush with the bottom faces of lower strips 30, 48, and 100, and is flush with the upper faces of cap plates 38, 58, 104 and 106. Sheathing is further flush with the upper surface of cap tie 68 after the cap tie 68 is added in the field.

In operation, a method for forming foundation wall arrangement 10 includes the steps of prefabricating the first foundation wall 12, prefabricating the second foundation wall 14, and prefabricating the third foundation wall portions 22 and 24. The steps of prefabricating the first and second foundation walls 12 and 14 and the third foundation wall portions 22 and 24 preferably includes the step of adding the sheathing 124. The first and second foundation walls 12 and 14 and the third foundation wall portions 22 and 24 are then shipped to the building site along with key ties or studs 66 and cap tie or stud 68. After the building site has been excavated, footing plates are set on rock footings, then the first and second foundation walls 12 and 14 and third foundation wall portions 22 and 24 are set on footing plates (typically two foot by eight foot strips of dimensional lumber). Then the third foundations wall portions 22 and 24 are properly aligned with the first and second foundation walls 12 and 14, and the walls 12, 14, 16, 18 and 20 are aligned as a whole. Then the third foundation wall portions 22 and 24 are tied into the end walls 12 and 14. Then the key tie or key stud 66 is tied into the third foundation wall portions 22 and 24 and the cap tie or cap stud 68 is tied into the third foundation wall portions 22 and 24. Alignment of the walls 12, 14, 16, 18 and 20 is then checked. Subsequently, concrete is poured to set the foundation wall arrangement 10 and its perfect or near perfect alignment.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A foundation wall arrangement, comprising:

(a) a first foundation wall;

(b) a second foundation wall;

(c) a third foundation wall, with the third foundation wall being disposed between the first and second foundation walls and extending transversely between the first and second foundation walls, with the third foundation wall comprising third foundation wall portions, with each of the third foundation wall portions having an upper section and an inner section, with the inner sections confronting each other, with the third foundation wall portions being generally in line with each other, with the third foundation wall portions being drawable to and away from each other such that one of the third foundation wall portions is drawable to and away from one of the first and second foundation walls and such that the other of the third foundation wall portion is drawable to and away from the other of the first and second foundation walls whereby the third foundation wall may be properly aligned with the first and second foundation walls; and (d) a tie for engaging one of the inner and upper sections of one of the third foundation wall portions with one of the inner and upper sections of the other third foundation wall portion to tie the third foundation wall portions to each other after the third foundation wall portions have been properly aligned with the first and second foundation walls.

2. The foundation wall arrangement of claim 1 wherein the tie comprises a cap tie for engaging the upper sections of the third foundation wall portions, with the cap tie being generally aligned with the third foundation wall portions.

3. The foundation wall arrangement of claim 1 wherein the tie comprises an upright stud engaging the inner sections of the third foundation wall portions.

4. The foundation wall arrangement of claim 1 and further comprising another tie, with one of the ties engaging the upper sections of the third foundation wall portions and with the other of the ties engaging the inner sections of the third foundation wall portions.

5. The foundation wall arrangement of claim 1 wherein each of the third foundation wall portions comprises an inner end, with each of the inner ends comprising a receptor formed at least in part by one of said inner sections, with the receptors confronting each other when the third foundation wall portions are placed end to end with the inner ends confronting each other, and with the tie being received in the receptor.

6. The foundation wall arrangement of claim 5, wherein each of the inner ends of the third foundation wall portions includes a pair of upright studs, with each of the upright studs having an upright face and an upright elongate edge, with the upright faces of one inner end being at least partially engaged to each other, and with the upright elongate edges of one inner end being offset from each other so to at least partially form the receptor for the tie.

7. The foundation wall arrangement of claim 6 wherein each of the third foundation wall portions comprises:

(a) a lower elongate support strip;

(b) an upper elongate support strip;

(c) connecting support studs between the first lower and upper elongate support strips and engaging the lower and upper elongate support strips; and (d) wherein the uprights studs having the receptor are engaged between the lower and upper elongate support strips.

8. The foundation wall arrangement of claim 1, wherein each of the third foundation wall portions includes an outer end, and a cap having outer and inner end portions, with each of the caps being on one of the third foundation wall portions, with said outer end portion of the cap extending beyond said outer end of said third foundation wall portion, with said inner end portion of the cap terminating short of said inner end of said third foundation wall portion, with the outer end portion of one of the caps being engaged to one of the first and second foundation walls and with the outer end portion of the cap on the other third foundation wall portion being engaged to the other of the first and second foundation walls, and wherein the tie includes two ends and is engaged to the third foundation wall portions between the caps, with one of the ends of the ties confronting one of the inner ends of one of the caps and with the other end of the tie confronting the other of the inner ends of the caps.

9. The foundation wall arrangement of claim 1 wherein the first foundation wall is prefabricated as a whole, wherein the second foundation wall is prefabricated as a whole, wherein one third foundation wall portion is prefabricated as a whole, wherein the other third foundation wall portion is prefabricated as a whole.

10. The foundation wall arrangement of claim 1 wherein each of the foundation walls consists essentially of wood and pin connectors.

11. The foundation wall arrangement of claim 1 wherein each of the first and second foundation walls comprises sheathing, and wherein each of the third foundation wall portions comprises sheathing.

12. A foundation wall arrangement, comprising:

(a) a first foundation wall comprising:

(i) a first lower elongate support strip;

(ii) a first upper elongate support strip; and (iii) first connecting support studs between the first lower and upper elongate support strips and engaging the lower and upper elongate support strips;

(b) a second foundation wall comprising:

(i) a second lower elongate support strip;

(ii) a second upper elongate support strip; and (iii) second connecting support studs between the first lower and upper elongate support strips and engaging the lower and upper elongate support strips;

(c) a third foundation wall, with the third foundation wall being disposed between the first and second foundation walls and extending transversely between the first and second foundation walls, with the third foundation wall comprising at least a pair of third foundation wall portions, with each of the third foundation wall portions comprising:

(i) a third lower elongate support strip;

(ii) a third upper elongate support strip;

(iii) third connecting support studs between the first lower and upper elongate support strips and engaging the lower and upper elongate support strips; and (iv) inner ends, with each of the inner ends of the third foundation wall portions including a pair of upright studs, with each of the upright studs having an upright face and an upright elongate edge, with the upright faces of one inner end being at least partially engaged to each other, and with the upright elongate edges of one inner end being offset from each other so to at least partially form a receptor; and (d) a key stud, with one portion of the key stud being engaged in the receptor of one inner end of one third foundation wall and with another portion of the key stud being engaged in the receptor of the inner end of the other foundation wall to tie the third foundation wall portions to each other.

13. A foundation wall arrangement, comprising:

(a) a first foundation wall comprising:

(i) a first lower elongate support strip;

(ii) a first upper elongate support strip; and (iii) first connecting support studs between the first lower and upper elongate support strips and engaging the lower and upper elongate support strips;

(b) a second foundation wall comprising:

(i) a second lower elongate support strip;

(ii) a second upper elongate support strip; and (iii) second connecting support studs between the first lower and upper elongate support strips and engaging the lower and upper elongate support strips;

(c) a third foundation wall, with the third foundation wall being disposed between the first and second foundation walls and extending transversely between the first and second foundation walls, with the third foundation wall comprising at least a pair of third foundation wall portions, with each of the third foundation wall portions comprising:

(i) a third lower elongate support strip;

(ii) a third upper elongate support strip;

(iii) third connecting support studs between the first lower and upper elongate support strips and engaging the lower and upper elongate support strips;

(iv) an inner end and an outer end;

(v) a cap, with each of the caps comprising outer and inner end portions, with said outer end portion of the cap extending beyond said outer end of said third foundation wall portion, with said inner end portion of the cap terminating short of said inner end of said third foundation wall portion, with the outer end portion of one of the caps being engaged to one of the first and second foundation walls and with the outer end portion of the cap on the other third foundation wall portion being engaged to the other of the first and second foundation walls; and (d) a cap tie, wherein the cap tie includes two ends and is engaged to the third foundation wall portions between the caps of each of the third foundation wall portions, with one of the ends of the cap tie confronting one of the inner ends of one of the caps and with the other end of the cap tie confronting the other of the inner ends of the caps to tie the third foundation wall portions to each other.

14. A method for forming a foundation wall arrangement comprising the steps of:

(a) prefabricating a first foundation wall;

(b) prefabricating a second foundation wall;

(c) prefabricating a third foundation wall portion and another third foundation wall portion, with each of the third foundation wall portions having an inner end and an outer end, with the steps of prefabricating the third foundation wall portions comprising the steps of forming a receptor portion in each of the inner ends of the third foundation wall portions and providing a first cap extending beyond said outer end of said third foundation wall portion;

(d) aligning one prefabricated third foundation wall portion with the first foundation wall;

(e) aligning the other prefabricated third foundation wall portion with the second foundation wall;

(f) providing a key stud and engaging the key stud in each receptor portion of the third foundation wall portions;

(g) providing a cap tie and engaging the cap tie between the caps of the third foundation wall portions; and (h) tying the third foundation wall portions to the first and second foundation walls, the cap tie to the third foundation wall portions, and the key stud to the third foundation wall portions to tie the third foundation wall portions to each other and to the first and second foundation walls.

15. The method of claim 14 wherein the steps of prefabricating the first and second foundation walls comprise the step of adding sheathing to the first and second foundation walls, and wherein the step of prefabricating the third foundation wall portions comprises the step of adding sheathing to the third foundation wall portions.

* * * * *